US008802948B2

(12) United States Patent
Blakeney

(10) Patent No.: US 8,802,948 B2
(45) Date of Patent: Aug. 12, 2014

(54) GUITAR SLIDE HOLDING SYSTEM AND APPARATUS

(75) Inventor: Timothy D. Blakeney, Bennington, VT (US)

(73) Assignee: Tim Blakeney's Practical Solutions LLC, Bennington, VT (US)

( * ) Notice: Subject to any disclaimer, the term of this patent is extended or adjusted under 35 U.S.C. 154(b) by 171 days.

(21) Appl. No.: 13/403,074

(22) Filed: Feb. 23, 2012

(65) Prior Publication Data

US 2013/0220100 A1 Aug. 29, 2013

(51) Int. Cl.
*G10D 3/00* (2006.01)

(52) U.S. Cl.
USPC ..... 84/329

(58) Field of Classification Search
USPC ..... 84/327–329, 315–317
See application file for complete search history.

(56) References Cited

U.S. PATENT DOCUMENTS 5,739,445 A * 4/1998 Terry et al. ..... 84/329
6,323,409 B1 11/2001 Surber
7,947,886 B2 5/2011 Hoyle

* cited by examiner

*Primary Examiner* — Kimberly Lockett
(74) *Attorney, Agent, or Firm* — Downs Rachlin Martin PLLC

(57) ABSTRACT

A guitar slide holder for supporting a guitar slide so that the guitar slide may be secured when not in use and then easily removed and positioned on a guitarist's finger. The guitar slide holder can be releasably attached to a guitar strap so as to be easily accessed by the guitarist. Alternatively, the guitar slide holder can be coupled to a microphone stand or similar object so as to assist in locating the guitar slide holder in a convenient position near the guitarist. The guitar slide holder improves the storage, access, and finger positioning of the guitar slide so as to provide the guitarist with the ability to easily transition between using a guitar slide and not.

20 Claims, 3 Drawing Sheets

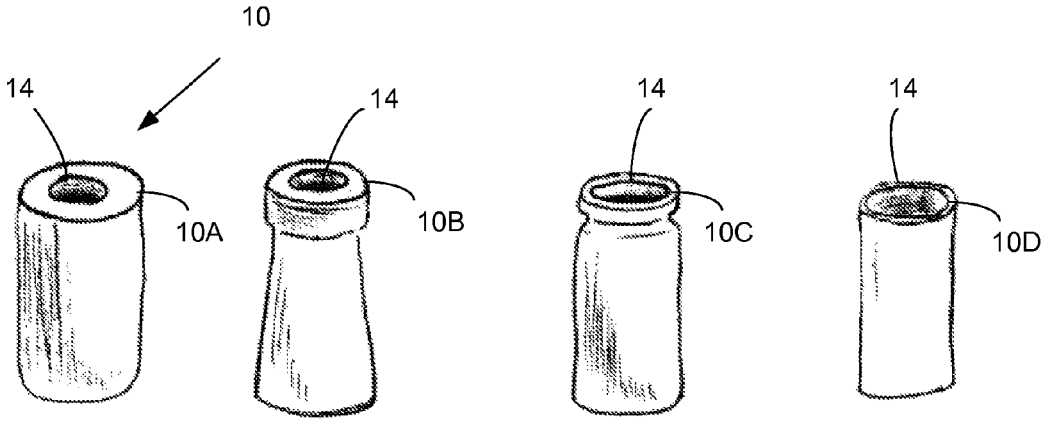
FIG. 1a Prior Art
FIG. 1b Prior Art
FIG. 1c Prior Art
FIG. 1d Prior Art
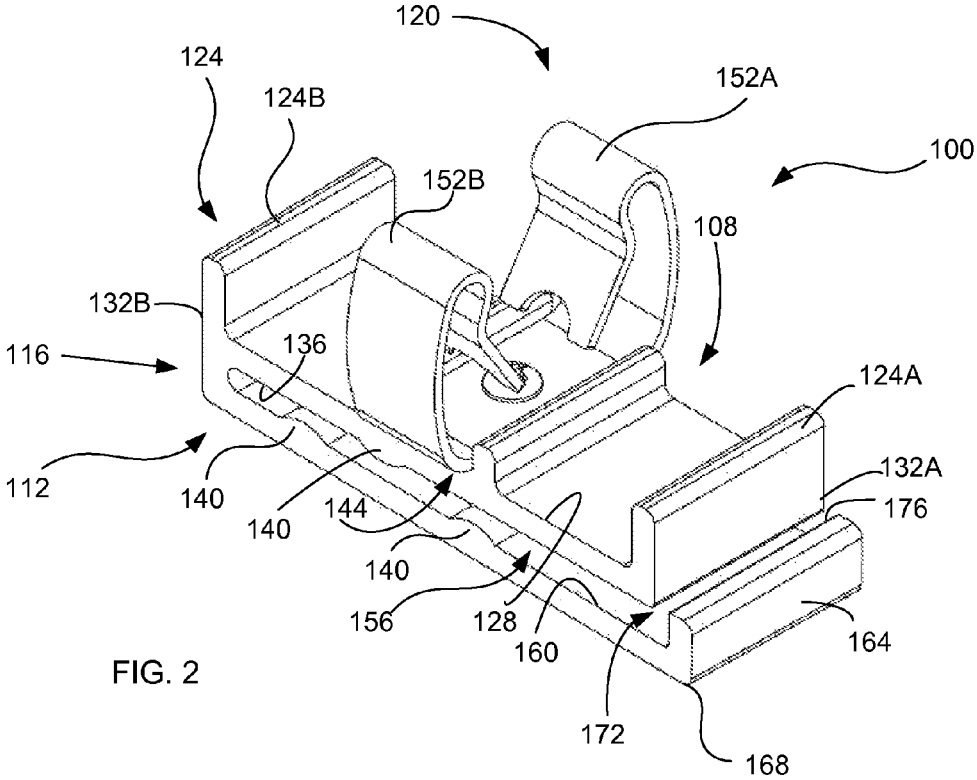
FIG. 2

GUITAR SLIDE HOLDING SYSTEM AND APPARATUS

FIELD OF THE INVENTION

The present invention generally relates to the field of musical instruments. In particular, the present invention is directed to an apparatus for holding a guitar slide.

BACKGROUND

Musicians, especially, guitar players, use a variety of devices to generate different sounds as they play. For example, guitar players often use a finger picks, thumb picks, and guitar slides (also referred to as a slide bar). As guitar players know, the guitar slide is worn on a finger and is slid along the strings of the guitar to produce a sound of varying pitch and unique timbre. While playing, the guitar player may desire to transition between playing the guitar with and without the guitar slide. Finding a place to store the guitar slide when not in use that also permits easy and quick access frustrates many guitar players.

SUMMARY OF THE DISCLOSURE

In a first aspect a guitar slide holder as described herein comprises: a retaining member; an upper support member having an upper interior surface, an upper outer surface, a first end, and a second end, wherein the first end and the second end each include a flange extending away from and transversely to the upper outer surface, and wherein the retaining member is mounted to the outer surface; and a lower support member coupled to and spaced from the upper support member so as to define a guitar strap gap therebetween, the lower support member having a lower interior surface, wherein the guitar strap gap is at least partially defined by the upper interior surface and the lower interior surface.

In another aspect, a guitar slide system as described herein comprises: a guitar slide having an external surface; and a guitar slide holder including: a guitar strap gap for receiving the guitar strap; a first support member sized and configured to support the guitar slide, the first support member including a first end and a second end and including a first flange disposed adjacent the first end and a second flange disposed adjacent the second end; and a retaining member disposed on the support member and sized and configured to engage the external surface of the guitar slide.

In yet another aspect, a guitar slide holder is described for storing, placing, and removing a guitar slide, the guitar slide holder comprising: a support member having an upper surface sized and configured to support the guitar slide; a first retaining member disposed on the support member and sized and configured to releasably engage the guitar slide; and a second retaining member disposed on an opposite side of the support member from the first retaining member, the second retaining member being sized and configured to releasably engage an elongate object.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein:

FIG. 1A is a perspective drawing of a prior art guitar slide;

FIG. 1B is a perspective drawing of a another prior art guitar slide;

FIG. 1C is a perspective drawing of a another prior art guitar slide;

FIG. 1D is a perspective drawing of a another prior art guitar slide;

FIG. 2 is a perspective view of a guitar slide holder according to an embodiment of the present invention;

DETAILED DESCRIPTION

Figure 3:
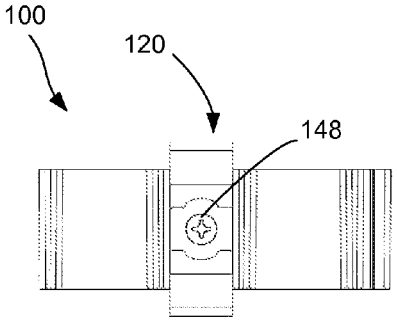
FIG. 3 is a top view of a guitar slide holder according to an embodiment of the present invention.

A guitar slide holder 100 according to the present disclosure allows for secure placement of a guitar slide 10 in the guitar slide holder and facilitates the proper placement of the guitar slide on a guitarist's finger when desired. Additionally, and according to certain embodiments, guitar slide holder 100 can be releasably attached to a guitar strap or to a microphone stand or similar elongate object so as to assist the guitarist in readily locating a guitar slide supported in the holder. Guitar slide holder 100 is designed to hold the guitar slide so as to provide the guitarist with the ability to easily transition between using the guitar slide and not.

FIGS. 1A-1D show various types of guitar slides 10, i.e. guitar slides 10A-10D, that are known in the art. Guitar slides 10 each include at least one opening 14 sized to receive a guitarist's finger with a suitably snug fit. Guitar slides 10 are generally cylindrical (e.g., guitar slides 10A and 10D in FIGS. 1A and 1D respectively) or can be of other configurations that are useful to the musician. Guitar slides 10 are usually formed of a rigid, smooth material such as, but not limited to, metal, e.g., steel or aluminum, synthetic plastic, porcelain, glass, or other suitable materials.

Turning now to FIGS. 2-5, there is shown an embodiment of guitar slide holder 100 for use with a guitar slide, such as one of guitar slides 10A-D (FIGS. 1A-D), and a guitar strap 104. Guitar slide holder 100 includes an upper support member 108 and a lower support member 112 that are coupled together at a connection point 116. Guitar slide holder 100 also includes a retaining member 120 mounted to upper support member 108. When in use with a guitar slide 10 and guitar strap 104, the guitar slide is held in retaining member 120 and the guitar strap is wedged between upper support member 108 and lower support member 112.

Upper support member 108 is sized and configured to support the entire length of a guitar slide, such as guitar slide 10A (FIG. 1A). As shown in FIG. 2, upper support member 108 includes opposing flanges 124A-B and an upper outer surface 128. Flanges 124A-B are disposed to extend transversely to, e.g., perpendicularly in some embodiments, to upper outer surface 128 and at respective ends 132A-B of the upper support member. Opposite and generally parallel to upper outer surface 128 is an upper interior surface 136, which can include a strap engagement member 140 (discussed further below with reference to FIG. 5).

Each flange 124 can serve to limit longitudinal movement of guitar slide 10 when being inserted into guitar slide holder 100 or removed from the guitar slide holder. For example, when a guitarist wishes to remove guitar slide 10 from guitar slide holder 100, the guitarist partially inserts a finger into the open end of the guitar slide, thereby moving the guitar slide toward flange 124A. Once the guitar slide abuts flange 124A, the guitarist inserts the finger to the proper depth within guitar slide 10 and then removes the guitar slide from guitar slide holder 100. When the guitarist wishes to return guitar slide 10 to guitar slide holder 100, the guitarist couples the guitar slide to the guitar slide holder and slides the guitar slide toward flange 124B. Once the guitar slide abuts flange 124B, the guitarist can easily remove the finger.

Figure 4:
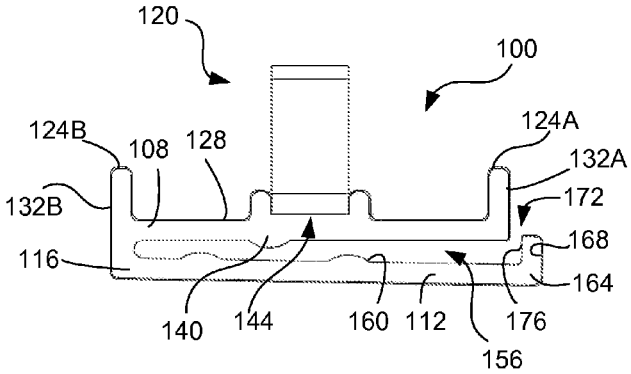
FIG. 4 is a side view of a guitar slide holder according to an embodiment of the present invention.

As shown in FIGS. 2 and 4, flanges 124A-B are about the same size and configuration so as to allow for the insertion and removal of a guitarist's finger into guitar slide 10 from either side of guitar slide holder 100. In an alternative embodiment, one flange 124 may be sized and configured so as to inhibit the insertion of a finger into guitar slide 10 from one end 124 of guitar slide holder 100.

Upper outer surface 128 is, in one embodiment, substantially planar and has a length along its longitudinal axis sufficient to support an entire guitar slide 10. In an exemplary embodiment, upper outer surface 128 has a length that is greater than the length of guitar slide 10 so as to guard against the inadvertent removal of the guitar slide from guitar slide holder 100. Upper outer surface 128 can also include a recess 144 that receives a portion of retaining member 120. The use of recess 144 allows guitar slide 10 to rest proximate upper outer surface 128 thereby minimizing wobbling of the guitar slide while mounted in guitar slide holder 100.

The size and configuration of recess 144 can be dependent upon the portion and type of retaining member 120 to be received. In the embodiment shown in FIGS. 2-4, recess 144 has a longitudinal axis perpendicular to the longitudinal axis of upper outer surface 128 and a depth that is sufficient to situate a portion of retaining member 120 and a coupling member 148 (best seen in FIG. 3) below the plane of the upper outer surface 128 (best seen in FIG. 2). In this embodiment, the depth of recess 144 also minimizes the possibility of either the retaining member 120 or coupling member 148 scratching or marring the surface of guitar holder 100.

Figure 5:
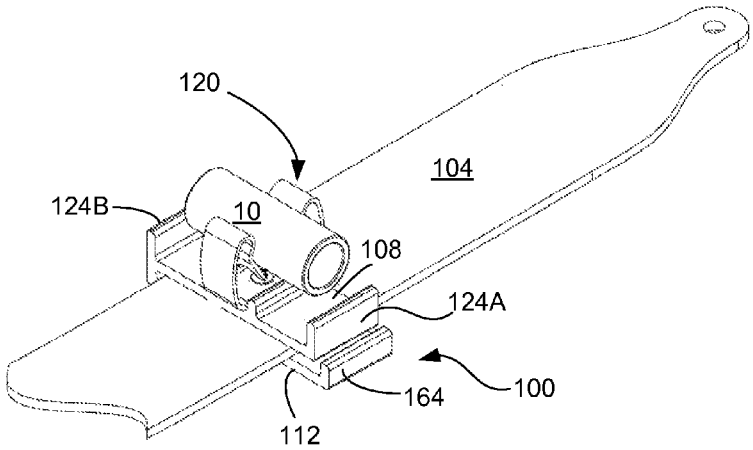
FIG. 5 is a perspective view of a guitar slide holder attached to a guitar strap according to an embodiment of the present invention.

Retaining member 120 accepts guitar slide 10, such as guitar slide 10A, as shown in FIGS. 1A and 5, and retains it unit the guitarist desires to use it. In an exemplary embodiment, retaining member 120 is sized and configured to springingly engage an outer wall of guitar slide 10 with a pair of arms 152A-B. Arms 152A-B have flexible inner portions that resiliently move from an engaged position when guitar slide 10 is in guitar slide holder 100 and a non-engaged position (FIG. 2). In an alternative embodiments of guitar slide holder 100, more than one retaining member 120 may be used to hold guitar slide 10. Retaining member 120 may also take on other forms such as, but not limited to, single or double sided pipe clips.

Upper support member 108 and lower support member 112 define a guitar strap gap 156 that is sized and configured to accept guitar strap 104. Guitar strap gap 156 is partially defined by upper interior surface 136, which is opposite upper outer surface 128. Upper interior surface 136 can include one or more strap engagement members 140 (only one shown on upper interior surface 136 in FIGS. 2-5). Strap engagement members 140 may be formed as protuberances that are sized and configured to engage guitar strap 104 and prevent the inadvertent sliding or removal of guitar slide holder 100. In alternative embodiments, strap engagement members 140 can be of various shapes and sizes and may be coated or include a material that enhances the engagement of guitar holder 100 with guitar strap 104.

Guitar strap gap 156 is also partially defined by a lower interior surface 160 of lower support member 112. Lower interior surface 160 can also include one or more strap engagement members 140. In the embodiment shown in FIGS. 2-5, lower interior surface 160 includes two strap engagement members 140 that are offset along the longitudinal axis of guitar holder 100 from the strap engagement member of upper interior surface 136.

In an alternative embodiment, a removable band (not shown) may be used to assist in the engagement of guitar strap 104. The removable band may be sized and positioned so as to move lower support member 112 and upper support member 108 closer together, thereby preventing the inadvertent sliding or removal of the guitar strap from guitar slide holder 100. Use of the removable band may be desirous when guitar strap 104 has a thickness that is significantly smaller than guitar strap gap 156. The removable band may be used in addition to one or more strap engagement members 140 or may be used in lieu of the strap engagement members.

Lower support member 112 also includes a flange 164 at end 168 that extends transversely to lower interior surface 160. Flange 164 is sized and configured limit inadvertent removal of guitar strap 104 from guitar strap gap 156. In an exemplary embodiment, lower support member 112 is sized and configured such that flange 164 is located beyond end 124A and is dimensioned so as to substantially block access to guitar strap gap 156 except through a strap entrance 172, which is defined by an inner surface 176 of flange 164 and end 124A (best seen in FIG. 4). In certain embodiments, it may be desirable to make lower support member 112 somewhat longer than upper support member 108 so that flange 164 is positioned outboard of end 124A (i.e., to the left of end 124A as shown in FIG. 4).

As mentioned above, connection point 116 is the portion of guitar holder 100 that connects upper support member 108 and lower support member 112. In an exemplary embodiment, guitar slide holder 100 is a unitary body, such that connection point 116 is integral with upper support member 108 and lower support member 112. In alternative embodiments, upper support member 108 and lower support member 112 may be coupled together at connection point 116 by methods known in the art, such as, but not limited to, a glue, a fastener, an interconnecting joint (i.e. dovetail, box, hinged joint, etc.).

Guitar slide holder 100 can be made from materials known in the art, such as, but not limited to wood, plastics, metals, and the like. In an exemplary embodiment, the materials for guitar slide holder 100 are chosen so as to have a resilience and pliability such that upper support member 108 and lower support member 112 can be spread apart slightly to allow for the insertion of guitar strap 104 in guitar strap gap 156 and then to return to their original position.

Figure 6:
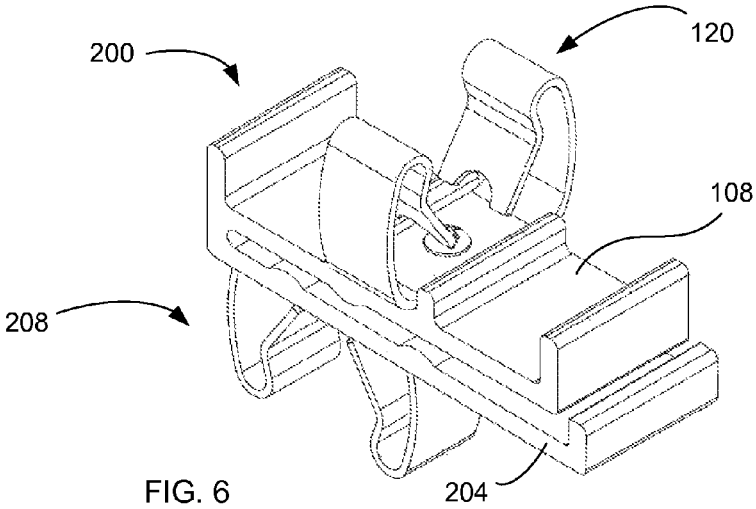
FIG. 6 is a perspective view of an alternative guitar slide holder according to an embodiment of the present invention.
Figure 7:
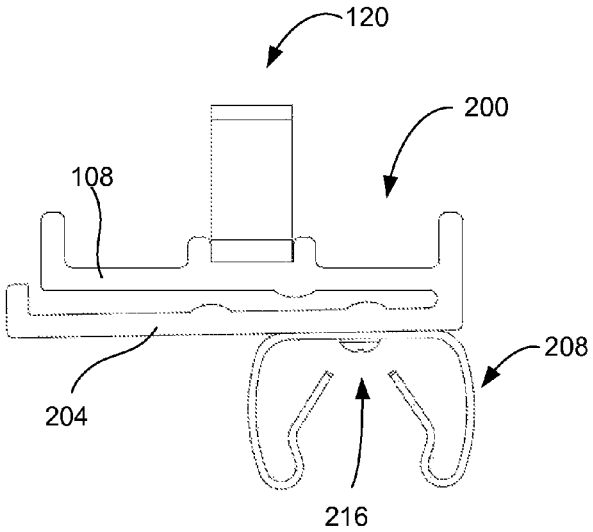
FIG. 7 is a side view of an alternative guitar slide holder according to an embodiment of the present invention.
Figure 8:
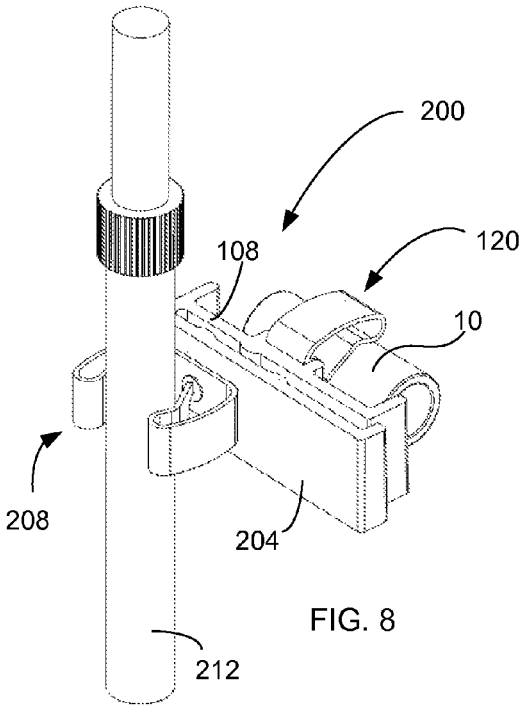
FIG. 8 is a perspective view of an alternative guitar slide holder engaged with a microphone stand according to an embodiment of the present invention.

Turning now to FIGS. 6-8 there is shown a guitar slide holder 200 according to another embodiment of the present invention. In this embodiment, lower support member 204 has mounted to it a second retaining member 208. Second retaining member 208 is positioned in transverse relationship to retaining member 120. Second retaining member 208 is sized and configured to semi-permanently attach to a microphone stand 212 or other elongate structure (as seen in FIG. 8). In this regard, second retaining member 208 can be, but is not limited to, a clip or a strap, such as a hook and loop fastener. Second retaining member 208 can also be designed and configured to have a more permanent attachment to microphone stand 212. In this alternative embodiment, second retaining member 208 may be, but is not limited to, a pipe clamp. In another exemplary embodiment, second retaining member 208 may be rotatable about a pivot 216, such that the guitarist may conveniently position guitar slide holder into an accessible position on the cylindrical pole.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A guitar slide holder, comprising:

a retaining member;

an upper support member having an upper interior surface, an upper outer surface, a first end, and a second end, wherein said first end and said second end each include a flange extending away from and transversely to said upper outer surface, and wherein said retaining member is mounted to said outer surface; and a lower support member coupled to and spaced from said upper support member so as to define a guitar strap gap therebetween, said lower support member having a lower interior surface, wherein said guitar strap gap is at least partially defined by said upper interior surface and said lower interior surface.

2. A guitar slide holder according to claim 1, wherein at least one of said upper interior surface and said lower interior surface includes one or more protuberances configured to engage the guitar strap.

3. A guitar slide holder according to claim 1, wherein said upper support member has a first length and lower support member has a second length, further wherein said second length is greater than said first length.

4. A guitar holder according to claim 3, wherein said lower support member further includes a flange extending away from and transversely to said lower interior surface.

5. A guitar holder according to claim 1, wherein said retaining member is configured to springingly engage an outer surface of the guitar slide.

6. A guitar holder according to claim 1, where said upper outer surface includes a recess sized and configured to receive a portion of said retaining member.

7. A guitar holder according claim 6, wherein said retaining member is configured to springingly engage an outer surface of the guitar slide.

8. A guitar slide system positionable on a guitar strap, comprising:

a guitar slide having an external surface; and a guitar slide holder including:

a guitar strap gap for receiving the guitar strap;

a first support member sized and configured to support said guitar slide, said first support member including a first end and a second end and including a first flange disposed adjacent said first end and a second flange disposed adjacent said second end; and a retaining member disposed on said support member and sized and configured to engage said external surface of said guitar slide.

9. A guitar slide system according to claim 8, wherein said guitar strap guide member includes one or more protuberances configured to engage the guitar strap.

10. A guitar slide system according to claim 8, wherein said guitar slide holder includes a second support member adjacent to and spaced from said first support member so as to define a strap entrance.

11. A guitar slide system according to claim 10, wherein said second support member has a flange that partially defines said strap entrance.

12. A guitar slide system according to claim 8, wherein said retaining member is configured to springingly engage said external surface.

13. A guitar slide system according to claim 8, where said support member surface includes a recess sized and configured to receive a portion of said retaining member.

14. A guitar slide system according claim 13, wherein said retaining member is configured to springingly engage said external surface.

15. A guitar slide system according to claim 8, wherein said retaining member only engages said external surface with a single pipe clip.

16. A guitar slide holder for storing, placing, and removing a guitar slide, the guitar slide holder comprising:

a support member having an upper surface sized and configured to support the guitar slide;

a first retaining member disposed on said support member and sized and configured to releasably engage the guitar slide; and a second retaining member disposed on an opposite side of said support member from said first retaining member, said second retaining member being sized and configured to releasably engage an elongate object.

17. A guitar slide holder according to claim 16, where said upper surface includes a recess sized and configured to receive a portion of said retaining member.

18. A guitar slide holder according claim 16, wherein said first retaining member is configured to springingly engage the guitar slide.

19. A guitar slide holder according to claim 18, wherein said first retaining member only engages the guitar slide with a single pipe clip.

20. A guitar slide holder according to claim 16, wherein said second retaining member is a pipe clip.

* * * * *